US009166317B2

(12) United States Patent
Briant et al.

(10) Patent No.: US 9,166,317 B2
(45) Date of Patent: Oct. 20, 2015

(54) HIGH-SPEED CONNECTOR ASSEMBLY

(71) Applicant: Tyco Electronics Corporation, Berwyn, PA (US)

(72) Inventors: Eric David Briant, Dillsburg, PA (US); Michael John Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 71 days.

(21) Appl. No.: 14/181,233

(22) Filed: Feb. 14, 2014

(65) Prior Publication Data

US 2015/0236437 A1 Aug. 20, 2015

(51) Int. Cl.
*H01R 24/00* (2011.01)
*H01R 12/73* (2011.01)

(52) U.S. Cl.
CPC ..... *H01R 12/737* (2013.01)

(58) Field of Classification Search
CPC ..... H01R 23/7068
USPC ..... 439/634, 637
See application file for complete search history.

(56) References Cited

U.S. PATENT DOCUMENTS

| | | | | |
|---|---|---|---|---|
| 4,293,179 | A * | 10/1981 | Vonder | 439/637 |
| 5,098,311 | A | 3/1992 | Roath et al. | |
| 5,820,392 | A * | 10/1998 | Lin et al. | 439/108 |
| 7,114,963 | B2 | 10/2006 | Shuey et al. | |
| 7,121,836 | B2 * | 10/2006 | Lai | 439/59 |
| 7,156,701 | B1 * | 1/2007 | Pennypacker et al. | 439/637 |
| 8,231,411 | B1 | 7/2012 | Westman et al. | |
| 2009/0215318 | A1 * | 8/2009 | Hass | 439/637 |

* cited by examiner

*Primary Examiner* — Phuong Dinh

(57) ABSTRACT

A receptacle connector includes a housing having a socket configured to receive a plug connector. The housing includes a cavity having datum surfaces therein. The receptacle connector includes a contact assembly received in the cavity and located in a fixed location relative to the datum surfaces. The contact assembly has a dielectric base holding a plurality of contacts configured to mate with the plug connector received in the socket. The dielectric base has datum surfaces. At least one of the housing or the dielectric base comprising crush ribs forcing the datum surfaces of the dielectric base to engage corresponding datum surfaces of the housing.

20 Claims, 5 Drawing Sheets

HIGH-SPEED CONNECTOR ASSEMBLY

BACKGROUND

The subject matter herein relates generally to high-speed electrical connectors.

Various communication or computing systems use electrical connectors for transmitting data signals between different components of the system. For example, computers may use circuit cards, such as processor or memory modules, that interconnect with one another. A circuit card may be installed in a connector assembly that is mounted on a motherboard, or other system board, to interconnect the circuit card to the motherboard.

The various components may have a plug connector that mate with a receptacle connector. For example, the circuit cards often include a plug connector that is received within a socket of the receptacle connector. The plug and receptacle connectors include electrical contacts that mate together when the plug connector is received within the socket of the receptacle connector. The electrical contacts are positioned close to one another to increase the number of electrical connections available. However, the close proximity requires precise alignment of the card edge and the connector assembly.

A need remains to improve the alignment of contacts in an electrical connector assembly.

BRIEF DESCRIPTION

In an embodiment, a receptacle connector is disclosed. The receptacle connector includes a housing having a socket configured to receive a plug connector. The housing has a bottom configured to be mounted to a circuit board. The housing has a cavity open at the bottom and open to the socket. The housing has datum surfaces in the cavity. The receptacle connector includes a contact assembly received in the cavity and located in a fixed location relative to the datum surfaces. The contact assembly has a plurality of contacts arranged in two rows configured to mate with opposite sides of the plug connector received in the socket. Each contact has a main body, a mating beam extending from the main body, and a tail extending from the main body opposite the mating beam. The mating beams terminate to the plug connector. The tails terminate to the circuit board. The contact assembly has a dielectric base holding the main bodies of the contacts. The dielectric base has datum surfaces. At least one of the housing or the dielectric base comprises crush ribs forcing the datum surfaces of the dielectric base to engage corresponding datum surfaces of the housing.

In an embodiment, a receptacle connector is disclosed. The receptacle connector includes a housing having a socket extending along a longitudinal axis of the connector assembly. The socket is configured to receive a plug connector. The housing has a bottom configured to be mounted to a circuit board. The housing has a cavity open at the bottom and open to the card socket. The housing has datum surfaces in the cavity. The receptacle connector also includes a contact assembly received in the cavity and located in a fixed location relative to the datum surfaces. The contact assembly has a plurality of contacts arranged in two rows configured to mate with opposite sides of the plug connector received in the socket. Each contact has a main body, a mating beam extending from the main body, and a tail extending from the main body opposite the mating beam. The mating beam terminates to the plug connector. The tail terminates to the circuit board. The contact assembly has a dielectric base holding the main bodies of the contacts. The dielectric base has datum surfaces, at least one flange extending along the longitudinal axis, and at least one flange extending along a lateral axis. The lateral axis is generally perpendicular to the longitudinal axis. At least one of the housing or the dielectric base comprises crush ribs forcing the datum surfaces of the dielectric base to engage corresponding datum surfaces of the housing.

In one embodiment, a connector assembly is disclosed. The connector assembly includes a plug connector. The connector assembly includes receptacle connector having a housing having a socket configured to receive the plug connector. The housing has a bottom configured to be mounted to a circuit board. The housing has a cavity open at the bottom and open to the socket. The housing has datum surfaces in the cavity. The receptacle connector includes a contact assembly received in the cavity and located in a fixed location relative to the datum surfaces. The contact assembly has a plurality of contacts arranged in two rows configured to mate with opposite sides of the plug connector received in the socket. Each contact has a main body, a mating beam extending from the main body, and a tail extending from the main body opposite the mating beam. The mating beams terminate to the plug connector and the tails mate with complementary contact pads of the circuit board. The contact assembly has a dielectric base holding the main bodies of the contacts. The dielectric base has datum surfaces. At least one of the housing or the dielectric base comprises crush ribs forcing the datum surfaces of the dielectric base to engage corresponding surfaces of the housing such that the contact pads of the circuit board align with the tails.

DETAILED DESCRIPTION

Figure 1:
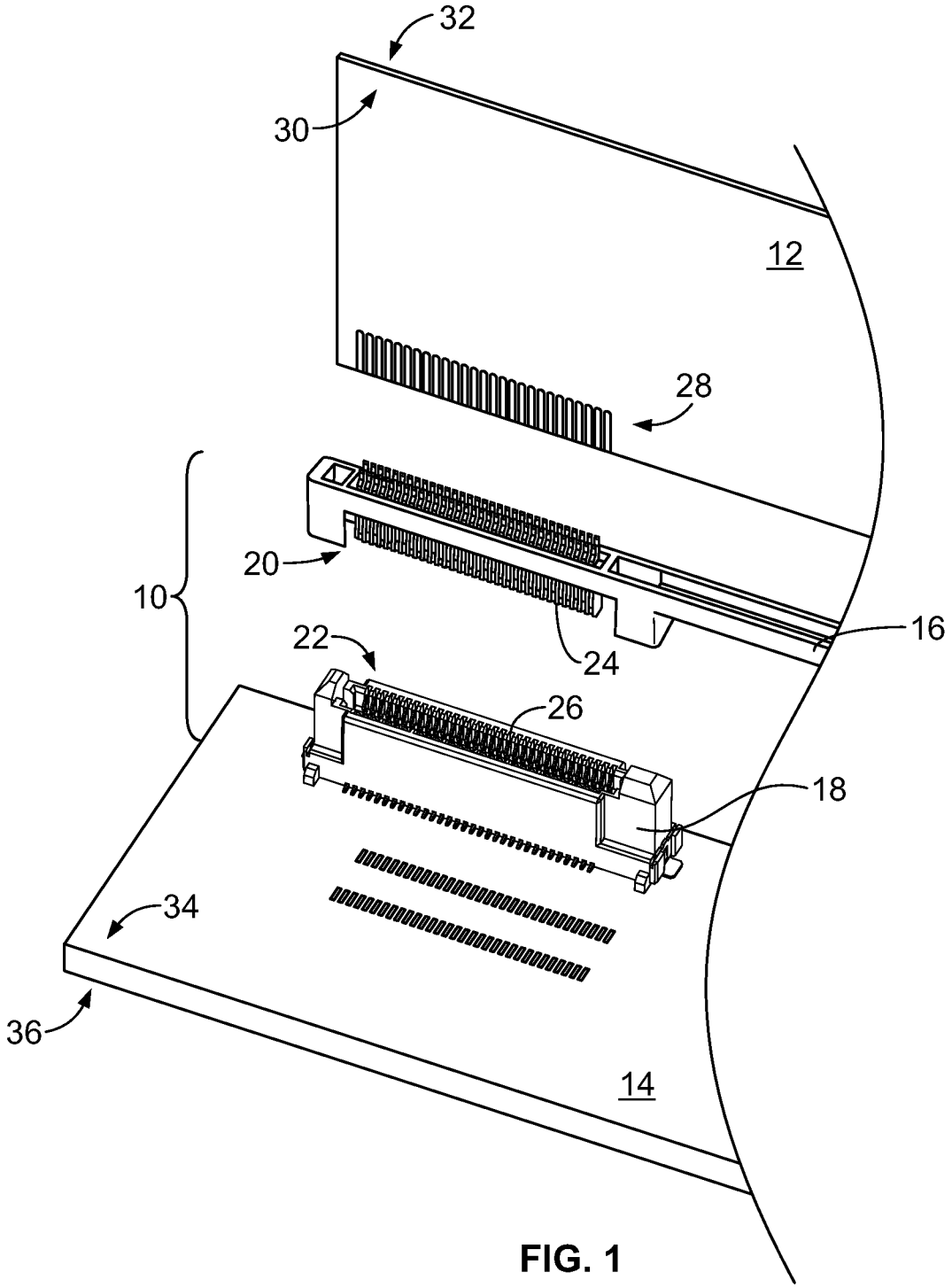
FIG. 1 is a perspective view of an embodiment of a connector assembly.

FIG. 1 is a perspective view of an embodiment of a connector assembly 10. In the illustrated embodiment, the connector assembly 10 is configured to electrically connect a circuit card 12 to a circuit board 14. But, the connector assembly 10 may be used to provide an electrical connection between any other type of electrical device and/or component. The connector assembly 10 includes a plug connector 16 and a receptacle connector 18. The plug connector 16 is electrically connected to the circuit card 12, while the receptacle connector 18 is electrically connected to the circuit board 14. The plug connector 16 and the receptacle connector 18 mate together to establish an electrical connection between the circuit card 12 and the circuit board 14. Specifically, when a plug 20 of the plug connector 16 is received within a socket 22 of the receptacle connector 18, electrical contacts 24 of the plug connector 16 mate with corresponding electrical contacts 26 of the receptacle connector 18 to electrically connect the plug connector 16 to the receptacle connector 18. In this manner, the connector assembly 10 electrically connects the circuit card 12 to the circuit board 14.

In the illustrated embodiment of FIG. 1, the plug connector 16 is a discrete component from the circuit card 12 that is mounted to a card edge 28 of the circuit card 12 to electrically connect the plug connector 16 to the circuit card 12. Alternatively, the circuit card 12 mates directly with the receptacle connector 18. In other words, in some alternative embodiments, the plug connector 16 is defined by at least a portion of the card edge 28 of the circuit card 12 such that the card edge 28 of the circuit card 12 includes the plug 20.

In the illustrated embodiment of FIG. 1, the plug connector 16 is a straddle mount connector that straddles opposite sides 30 and 32 of the circuit card 12. But, the plug connector 16 may be any type of connector that is mounted to the circuit card 12 (in electrical connection therewith) in any other manner, configuration, geometry, and/or the like. For example, the plug connector 16 may be mounted to only one of the sides 30 or 32 of the circuit card 12 (whether the plug connector 16 is a right angle connector wherein the plug 20 extends approximately parallel to the circuit card 12 or a vertical connection wherein the plug 20 extends approximately perpendicular to the circuit card 12) and/or the like.

Although shown as being a vertical connector wherein the socket 22 extends approximately perpendicular to the circuit board 14, the receptacle connector 18 may be mounted to the circuit board 14 in any other manner, configuration, geometry, and/or the like. For example, the receptacle connector 18 may be a right angle connector that is mounted to the circuit board 14 such that the socket 22 extends approximately parallel to the circuit board 14, the receptacle connector 18 may be a straddle mount connector that is mounted to the circuit board 14 such that the receptacle connector 18 straddles opposite sides 34 and 36 of the circuit board 14, and/or the like.

Moreover, although the circuit card 12 and the circuit board 14 are oriented approximately perpendicular to each other in the illustrated embodiment, the connector assembly 10 may be configured to provide an electrical connection between circuit boards and/or other electrical devices and/or components that extend at any other angle relative to each other, such as, but not limited to, approximately parallel, an oblique angle, and/or the like.

Figure 2:
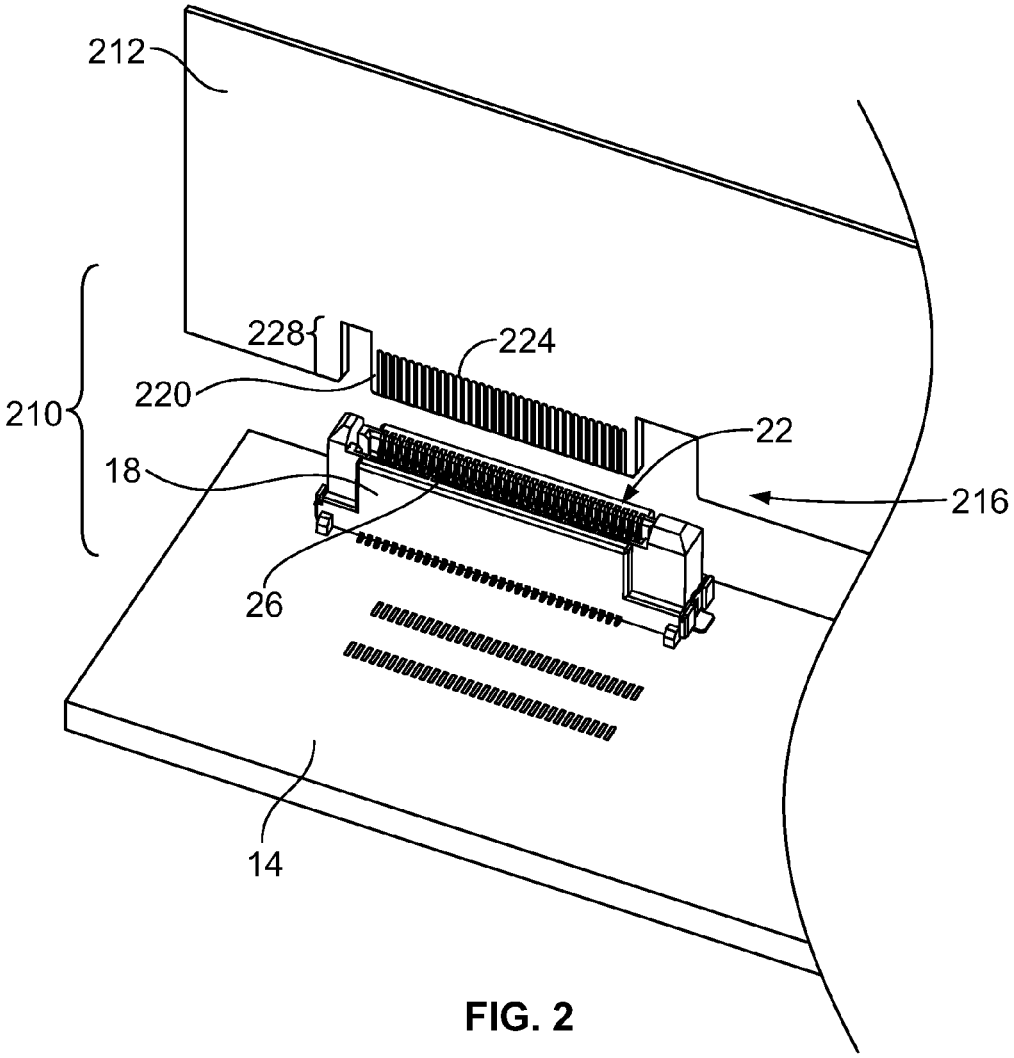
FIG. 2 is an exploded perspective view of another embodiment of a connector assembly.

FIG. 2 is an exploded perspective view of another embodiment of a connector assembly 210. FIG. 2 illustrates an embodiment wherein a plug connector 216 is defined by a card edge 228 of the circuit card 212. Specifically, the connector assembly 210 includes a plug connector 216 and the receptacle connector 18, which mate together to establish an electrical connection between a circuit card 212 and the circuit board 14. As shown in FIG. 2, a segment of the card edge 228 of the circuit card 212 defines a plug 220 of the plug connector 216 that directly mates with the receptacle connector 18. In other words, the plug 220 of the plug connector 216 of the circuit card 212 is received into the socket 22 of the receptacle connector 18 to mate the plug connector 216 and the receptacle connector 18 together in electrical connection. Specifically, the card edge 228 of the circuit card 212 includes a plurality of contact pads that define electrical contacts 224 of the plug connector 216. When the plug 220 of the plug connector 216 is received within the socket 22 of the receptacle connector 18, the electrical contacts 224 mate with corresponding electrical contacts 26 of the receptacle connector 18 to form an electrical connection between the connectors 216 and 18. The plug connector 216 may be considered a "card edge connector."

Figure 3:
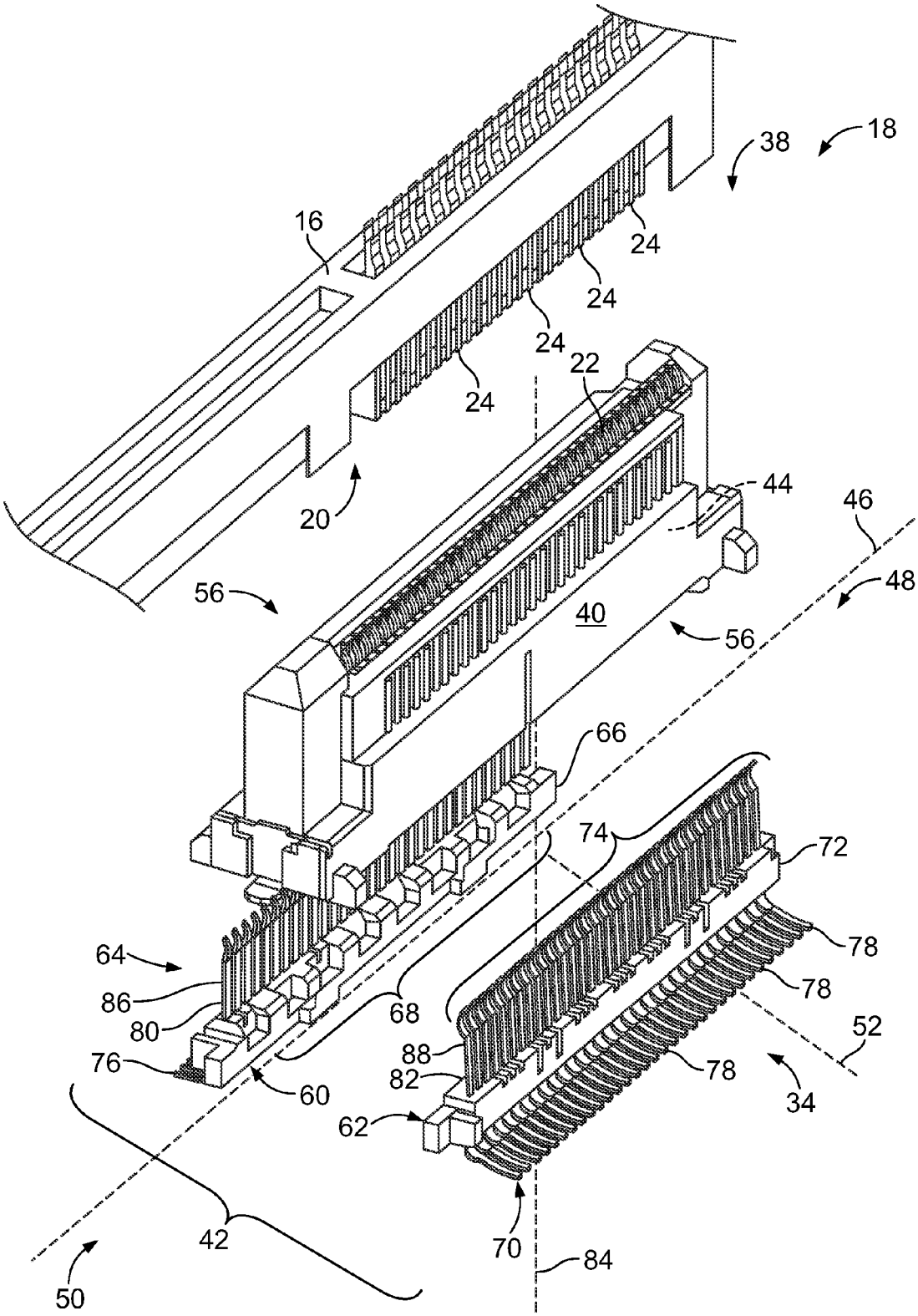
FIG. 3 is a partially exploded perspective view of an embodiment of a receptacle connector in accordance with an embodiment.

FIG. 3 is a partially exploded perspective view of an embodiment of the receptacle connector 18. The receptacle connector 18 includes a dielectric housing 40 configured to hold an electrical contact assembly 42 within a cavity 44. But the illustrated embodiment shows the contact assembly 42 removed from the housing 40 for clarity. The housing 40 extends in a longitudinal direction along a central longitudinal axis 46 from a first end 48 to an opposite, second end 50. The housing 40 extends in a lateral direction along a lateral axis 52 from a first side 54 and an opposite, second side 56. The first side 54 and the second side 56 extend between the first end 48 and the second end 50.

The socket 22 is framed between the first end 48, the second end 50, a first side 54, and the second side 56 of the housing 40. The housing 40 includes a bottom 58 configured to be mounted to the circuit board 14 (shown in FIG. 1). The cavity 44 is open at the bottom 58 and open to the socket 22.

The contact assembly 42 includes a first contact module 60 and a second contact module 62. The first contact module 60 includes a first set of contacts 64 and a first dielectric member 66. The first dielectric member 66 holds the first set of contacts 64 in a first row 68 extending in the longitudinal direction along the longitudinal axis 46. Similarly, the second contact module 62 includes a second set of contacts 70 and a second dielectric member 72. The second dielectric member 72 holds the second set of contacts 70 in a second row 74 that is parallel to the first row 68.

The first and second contacts 64, 70 include first and second tails 76, 78, respectively. The first and second contacts 64, 70 include first and second main bodies 80, 82, respectively. The first and second contacts 64, 70 include first and second mating beams 86, 88. The main bodies 80, 82 extend generally in the direction of a mating axis 84. The first main body 80 extends between the tail 76 and the mating beam 86. The second main body 82 extends between the tail 78 and the mating beam 88. The first dielectric member 66 is overmolded over a portion of the first main body 80. Similarly, the second dielectric member 72 is overmolded over a portion the second main body 82. Once overmolded, the contacts 64, 70 are held in position with respect to each other, such as at predetermined spacings.

A first mating beam 86 extends from the first main body 80 and a second mating beam 88 extends from the second main body 82. The mating beams 86, 88 extend toward the socket 22. For example, the first mating beam 86 may extend from the first main body 80 toward the top 38. When the plug 20 of the plug connector 16 is received within the socket 22 (for example, when the plug 20 is mated with the receptacle connector 18), the first mating beams 86 and the second mating beams 88 mate with the electrical contacts 24 of the plug connector 16. The first and second mating beams 86, 88 may be selectively sized and shaped to encourage electrical contact with the corresponding electrical contacts 24. For example, the first and second mating beams 86, 88 may include a raked S-shaped segment to form a spring-loaded connection with the electrical contacts 24.

The contacts 64, 70 include tails 76, 78 extending from their respective main bodies 80, 82. The tails 76, 78 extend generally from the first and second main bodies 80, 82 at an end opposite from the first and second mating beams 86, 88. The tails 76, 78 are configured to electrically terminate to the circuit board 14 (shown in FIG. 1). As shown in the illustrated embodiment, the tails 76, 78 may be bent approximately perpendicular to the main bodies 80, 82, generally parallel to the lateral axis 52 to allow the tails 76, 78 to be surface mounted to corresponding contact pads (not shown) on the surface of the circuit board 14. Alternatively, the tails 76, 78 may be positioned for mounting to vias or holes (not shown) in the circuit board 14.

Figure 4:
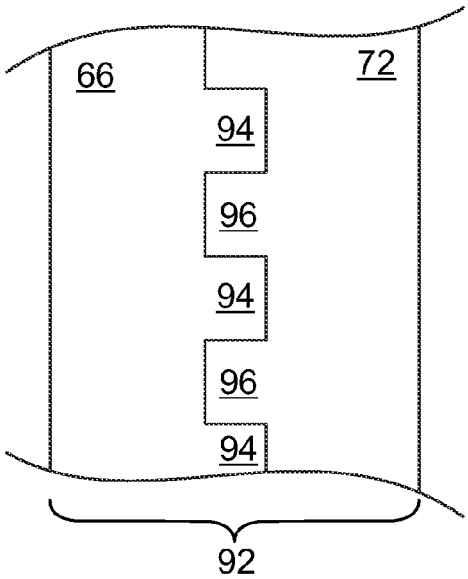
FIG. 4 is a partial top view of first and second dielectric member in the mated position in accordance with an exemplary embodiment.

FIG. 4, with continued reference to FIG. 3, is a partial top view of the first and second dielectric members 66, 72 in the mated position. The first and second dielectric members 66, 72 couple with one another to form a dielectric base 92. The first dielectric member 66 may include a first key component 94 that engages a second key component 96 on the second dielectric member 72. The first and second key components 94, 96 encourage alignment of the first and second dielectric members 66, 72. In the illustrated embodiment, the key components 94, 96 are embodied as an alternating square wave pattern. But other strategies may be used to internest the key components 94, 96.

Figure 5:
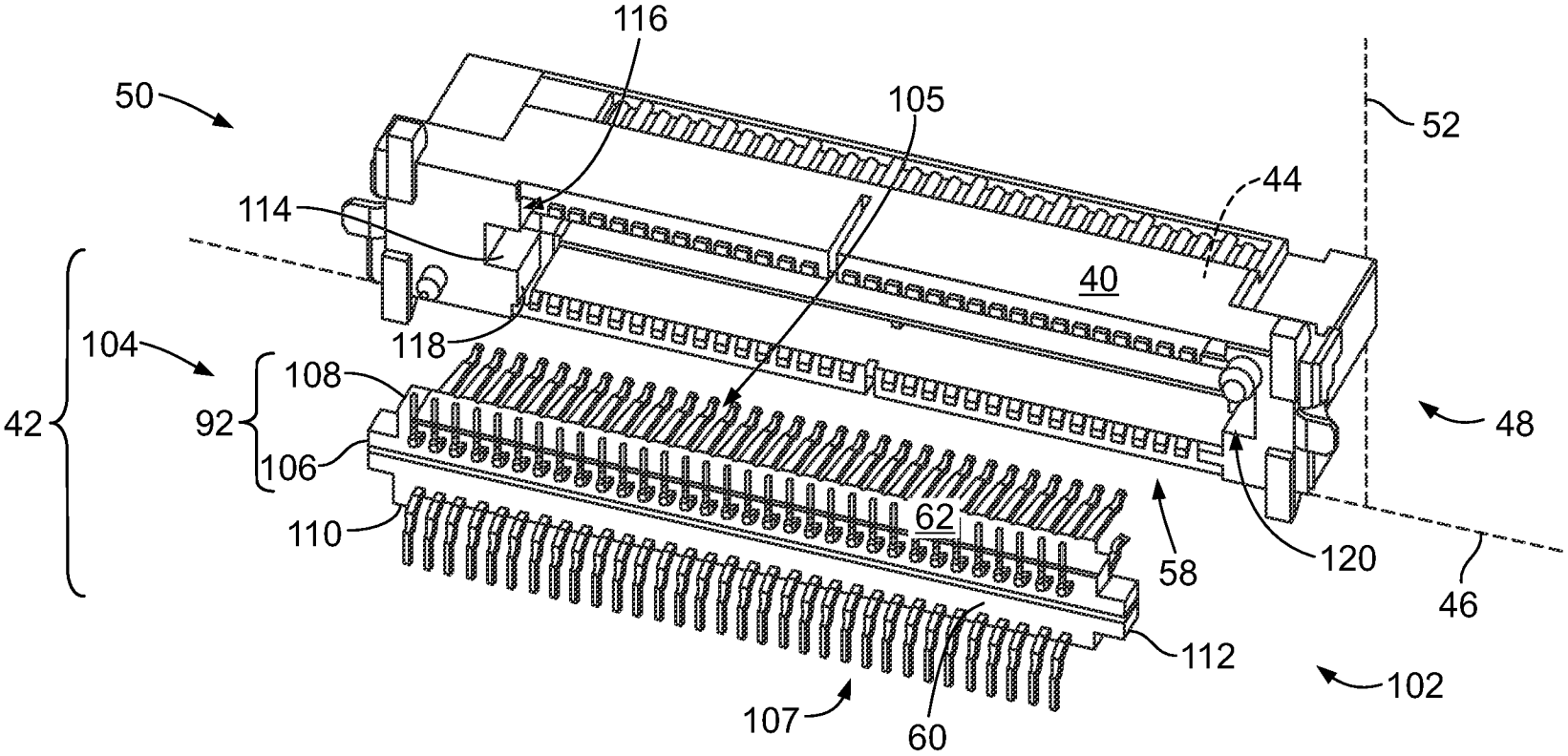
FIG. 5 is a partially exploded perspective view of a contact assembly poised for mounting to a housing in accordance with an embodiment.

FIG. 5 is a partially exploded perspective view of the contact assembly 42 poised for mounting to the housing 40. In the illustrated embodiment, the first and second contact modules 60, 62 are joined to one another to from the dielectric base 92 as discussed above in relation to FIG. 4. The contact assembly 42 has a first end 102 received in the first end 48 of the housing 40, and a second end 104 received in the second end 50 of the housing 40. The contact assembly 42 has a first side 105 that extends from the first end 102 to the second end 104, and a second side 107 that extends from the first end 102 to the second end 104 along a second face that is opposite of the first side 105. The contact assembly 42 may be inserted into the cavity 44 through the bottom 58.

The dielectric base 92 includes a first longitudinal flange 106 on the second end 104. The first longitudinal flange 106 extends generally along the direction of the longitudinal axis 46. The dielectric base 92 includes a first lateral flange 108 and a second lateral flange 110 (also shown in FIG. 6) on the second end 104. The lateral flanges 108, 110 are generally perpendicular to the longitudinal flange 106 (for example, the lateral flanges 108, 110 extend generally parallel to the lateral axis 52). The lateral flanges 108, 110 are axially aligned with one another along the longitudinal axis 46 such that the lateral flanges 108, 110 extend from opposite sides of the dielectric base 92. In various embodiments, the dielectric base 92 also includes a second longitudinal flange 112 at the first end 102. The flanges 106-112 may be keyed (for example, sized or positioned) to govern the orientation in which the dielectric base 92 is loaded into the housing 40. In embodiments having a second longitudinal flange, one or more of the flanges 106-112 may extend further than the others (for example, the first lateral flange 108 may be longer than the second lateral flange 110) to govern the orientation in which the dielectric base 92 is allowed to mate with the housing 40.

The flanges 106-112 are received within corresponding slots within the cavity 44. The slots are selectively dimensioned (for example, sized and shaped) to receive the flanges 106-112. In an exemplary embodiment, a first longitudinal slot 114 receives the first longitudinal flange 106. A first lateral slot 116 receives the first lateral flange 108. A second lateral slot 118 receives the second lateral flange 110. A second longitudinal slot 120 receives the second longitudinal flange 112.

Figure 6:
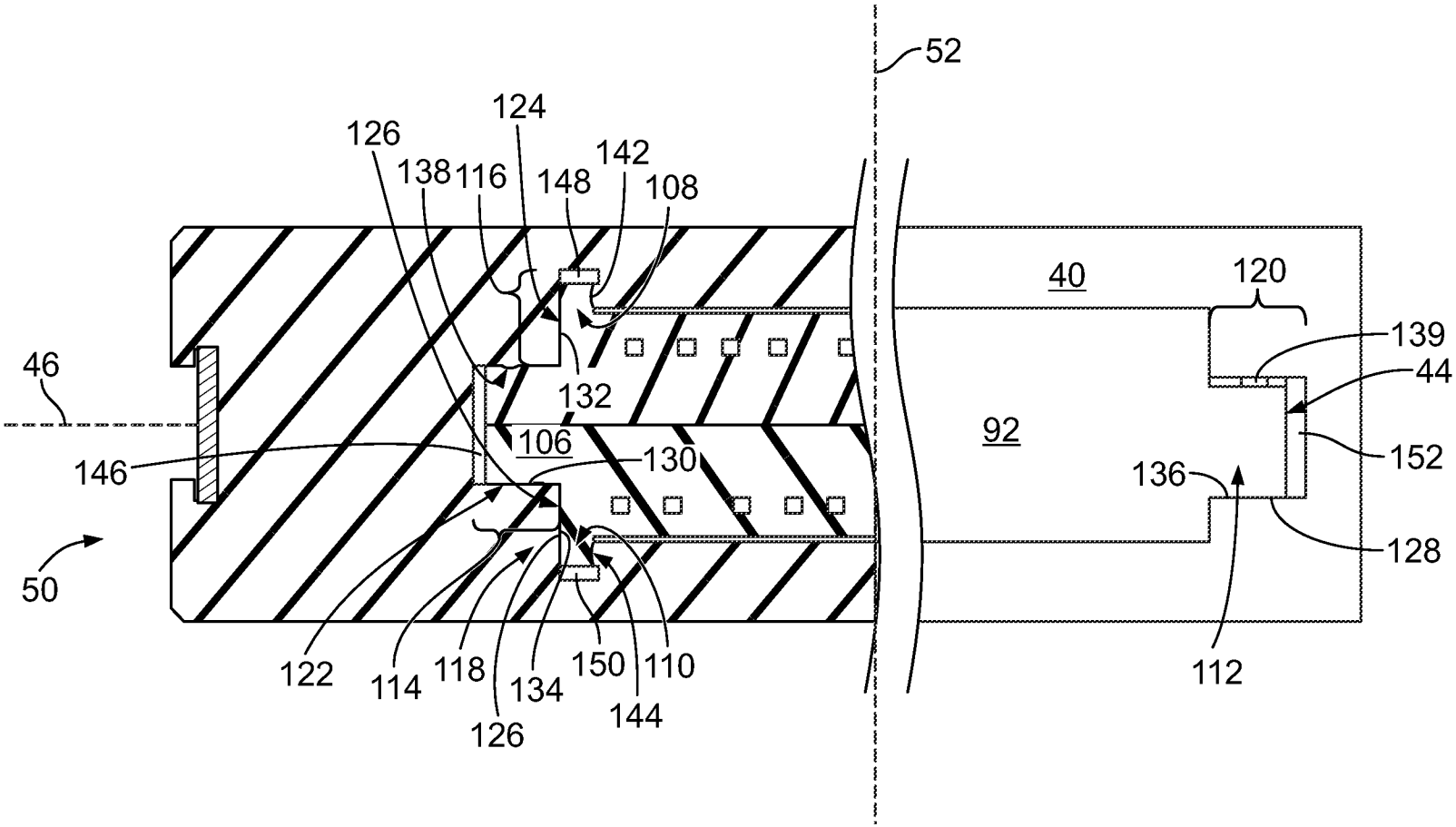
FIG. 6 is a partial cross sectional view of a dielectric base mated with a housing in accordance with an embodiment.

FIG. 6 is a partial cross-sectional view of the dielectric base 92 mated with the housing 40. In the illustrated embodiment, the dielectric base 92 is shown received in the cavity 44. The cavity 44 is selectively dimensioned to allow the dielectric base 92 of the contact assembly 42 (FIG. 3) to be positioned at a fixed location within the cavity 44 such that movement in the direction of the longitudinal axis 46 and the lateral axis 52 is reduced or eliminated. The housing 40 and the dielectric base 92 include datum surfaces to align the dielectric base 92 in the housing 40. Aligning the dielectric base 92 in the housing 40 allows the contacts 24 (shown in FIG. 1) to align with the contacts 26 (shown in FIG. 1) when the plug connector 16 is mated with the receptacle connector 18 (shown in FIG. 1).

In the illustrated embodiment, a first lateral datum surface 122 of the housing 40 extends along one side of the first longitudinal slot 114. The first lateral datum surface 122 engages a corresponding first lateral datum surface 130 on one surface of the first longitudinal flange 106. A first longitudinal datum surface 124 of the housing 40 extends along one side of the first lateral slot 116. The first longitudinal datum surface 124 engages a corresponding first longitudinal datum surface 132 on one surface of the first lateral flange 108. A second longitudinal datum surface 126 of the housing 40 extends along one side of the second lateral slot 118. The second longitudinal datum surface 126 engages a corresponding second longitudinal datum surface 134 on one surface of the second lateral flange 110. Similarly, a second lateral datum surface 128 of the housing 40 extends along one side of the second longitudinal slot 120. The second lateral datum surface 128 engages a corresponding second lateral datum surface 136 on the second longitudinal flange 112. The lateral datum surfaces 122, 128, 130, 136 limit the movement of the dielectric base 92 in a lateral direction along the lateral axis 52. The longitudinal datum surfaces 124, 126, 132, 134 limit the movement of the dielectric base 92 in a longitudinal direction along the longitudinal axis 46.

In the illustrated embodiment, the slots 114-120 include crush ribs opposite the datum surfaces 122-128. The first longitudinal slot 114 includes a lateral crush rib 138 on the side opposite the datum surface 122. Optionally, the second longitudinal slot 120 includes a lateral crush rib 140 on the side opposite the datum surface 128. The lateral crush ribs 138, 140 force the lateral datum surfaces 122, 128 on the housing 40 to engage the lateral datum surfaces 130, 136 on the dielectric base 92. As such, the lateral crush ribs 138, 140 force the dielectric base 92 in a lateral direction along the lateral axis 52. For example, the lateral crush ribs 138, 140 may exert a compressive force on the longitudinal flanges 106, 112 when the dielectric base 92 is loaded into the housing 40.

The first and second lateral slots 116, 118, include longitudinal crush ribs 142, 144 respectively on the sides opposite the datum surfaces 124, 126. The longitudinal crush ribs 142, 144 force the datum surfaces 124, 126 on the housing 40 to engage the longitudinal datum surfaces 132, 134 on the dielectric base 92. As such, the longitudinal crush ribs 142, 144 force the dielectric base 92 in a longitudinal direction parallel to the longitudinal axis 46 toward the second end 50 of the housing 40. For example, the longitudinal crush ribs 142, 144 may exert a compressive force on the lateral flanges 108, 110 when the dielectric base 92 is loaded into the housing 40. In various embodiments, other crush ribs may be provided on the flanges 106-112 instead of, or in addition to, the crush ribs 138-144 on the housing 40.

The cavity 44 is oversized relative to the dielectric base 92 to allow the dielectric base 92 to have a limited amount of floating movement within the cavity 44. The cavity 44 is oversized to form gaps 146, 148, 150, and 152 within the slots 114-120. The first longitudinal slot 114 extends beyond the first longitudinal flange 106 forming the gap 146 therebetween. The first lateral slot 116 extends beyond the first lateral flange 108 forming the gap 148 therebetween. The second lateral slot 118 extends beyond the second lateral flange 110 forming the gap 150 therebetween. The second longitudinal slot 120 extends beyond the second longitudinal flange 112 forming the gap 152 therebetween.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector comprising:

a housing having a socket configured to receive a plug connector, the housing having a bottom configured to be mounted to a circuit board, the housing having a cavity open at the bottom and open to the socket, the housing having datum surfaces in the cavity;

a contact assembly received in the cavity and located in a fixed location relative to the datum surfaces, the contact assembly having a plurality of contacts arranged in two rows configured to mate with opposite sides of the plug connector received in the socket, each contact having a main body, a mating beam extending from the main body and a tail extending from the main body opposite the mating beam, the mating beams for terminating to the plug connector, the tails for terminating to the circuit board, the contact assembly having a dielectric base holding the main bodies of the contacts, the dielectric base having datum surfaces;

wherein at least one of the housing or the dielectric base comprising crush ribs forcing the datum surfaces of the dielectric base to engage corresponding datum surfaces of the housing.

2. The receptacle connector of claim 1, wherein the dielectric base includes flanges extending therefrom, the flanges comprising the datum surfaces, the flanges at least one of including the crush ribs or being engaged by the crush ribs to force the datum surfaces of the flanges into engagement with the datum surfaces of the housing.

3. The receptacle connector of claim 1, wherein the socket extends along a longitudinal axis of the connector assembly, the dielectric base includes at least one longitudinal flange extending therefrom along the longitudinal axis, the dielectric base including lateral flanges extending from opposite sides of the dielectric base along a lateral axis of the connector assembly that is generally perpendicular to the longitudinal axis, the lateral flanges being received in corresponding slots in the cavity, the longitudinal flanges comprising longitudinal datum surfaces, the lateral flanges comprising lateral datum surfaces, the longitudinal datum surfaces engaging corresponding datum surfaces of the housing to locate the contact assembly within the cavity in a lateral direction along the lateral axis, the lateral datum surfaces engaging corresponding datum surfaces of the housing to locate the contact assembly within the cavity in a longitudinal direction along the longitudinal axis.

4. The receptacle connector of claim 3, wherein the dielectric base extends along the longitudinal axis between a first end and a second end, the longitudinal flanges being provided at both the first and second ends, the lateral flanges being axially aligned with each other along the longitudinal axis.

5. The receptacle connector of claim 1, wherein the housing extends along a longitudinal axis of the connector assembly between a first end and a second end, the housing having first and second sides extending between the first and second ends, the crush ribs force the dielectric base in a longitudinal direction along the longitudinal axis toward the first end, the crush ribs force the dielectric base in a lateral direction toward the first side along a lateral axis of the connector assembly that is generally perpendicular to the longitudinal axis.

6. The receptacle connector of claim 1, wherein the cavity is oversized relative to the dielectric base to allow the dielectric base to have a limited amount of floating movement within the cavity to align the datum surfaces of the dielectric base with the datum surfaces of the housing.

7. The receptacle connector of claim 6, wherein the dielectric base includes first and second ends and first and second sides extending between the first and second ends, wherein, when the datum surfaces of the dielectric base engage the datum surfaces of the housing, gaps are defined between the first and second ends and corresponding cavity walls of the housing defining the cavity and between the first and second sides and the corresponding cavity walls of the housing.

8. The receptacle connector of claim 1, wherein the contact assembly comprises a first contact module and a second contact module, the first contact module comprising a first set of the contacts and a first dielectric member holding the first set of the contacts in a first row, the second contact module comprising a second set of the contacts and a second dielectric member holding the second set of the contacts in a second row, the first and second dielectric members being coupled together to form the dielectric base.

9. The receptacle connector of claim 8, wherein the first dielectric member is overmolded over the main bodies of the first set of contacts and wherein the second dielectric member is overmolded over the main bodies of the second set of contacts.

10. The receptacle connector of claim 1, wherein the socket is open at a top of the housing to receive the plug connector.

11. A receptacle connector comprising:

a housing having a socket extending along a longitudinal axis of the connector assembly, the socket configured to receive a plug connector, the housing having a bottom configured to be mounted to a circuit board, the housing having a cavity open at the bottom and open to the plug connector, the housing having datum surfaces in the cavity;

a contact assembly received in the cavity and located in a fixed location relative to the datum surfaces, the contact assembly having a plurality of contacts arranged in two rows configured to mate with opposite sides of the plug connector received in the socket, each contact having a main body, a mating beam extending from the main body and a tail extending from the main body opposite the mating beam, the mating beams for terminating to the plug connector, the tails for terminating to the circuit board, the contact assembly having a dielectric base holding the main bodies of the contacts, the dielectric base having datum surfaces, at least one flange extending along the longitudinal axis, and at least one flange extending along a lateral axis, the lateral axis being generally perpendicular to the longitudinal axis;

wherein at least one of the housing or the dielectric base comprising crush ribs forcing the datum surfaces of the dielectric base to engage corresponding datum surfaces of the housing.

12. The receptacle connector of claim 11, wherein the dielectric base extends along the longitudinal axis between a first end and a second end, the one or more longitudinal flanges being provided at both the first and second ends, the one or more lateral flanges being axially aligned with each other along the longitudinal axis.

13. The receptacle connector of claim 11, wherein the housing extends along the longitudinal axis of the connector assembly between a first end and a second end, the housing having first and second sides extending between the first and second ends, the crush ribs force the dielectric base in a longitudinal direction along the longitudinal axis toward the first end, the crush ribs force the dielectric base in a lateral direction toward the first side along the lateral axis.

14. The receptacle connector of claim 11, wherein the cavity is oversized relative to the dielectric base to allow the dielectric base to have a limited amount of floating movement within the cavity to align the datum surfaces of the dielectric base with the datum surfaces of the housing.

15. A connector assembly comprising:

a plug connector;

a receptacle connector comprising:

a housing having a socket configured to receive the plug connector, the housing having a bottom configured to be mounted to a circuit board, the housing having a cavity open at the bottom and open to the socket, the housing having datum surfaces in the cavity; and a contact assembly received in the cavity and located in a fixed location relative to the datum surfaces, the contact assembly having a plurality of contacts arranged in two rows configured to mate with opposite sides of the plug connector received in the socket, each contact having a main body, a mating beam extending from the main body and a tail extending from the main body opposite the mating beam, the mating beams for terminating to the plug connector, the tails for mating with complementary contact pads of the circuit board, the contact assembly having a dielectric base holding the main bodies of the contacts, the dielectric base having datum surfaces;

wherein at least one of the housing or the dielectric base comprising crush ribs forcing the datum surfaces of the dielectric base to engage corresponding datum surfaces of the housing such that the contact pads of circuit board align with the tails.

16. The connector assembly of claim 15, wherein the contact pads along the plug connector further comprise signal contacts and ground contacts.

17. The connector assembly of claim 15, wherein the contact pads extend along first and second sides of the circuit board.

18. The connector assembly of claim 15, wherein the socket is open at a top of the housing to receive the plug connector.

19. The connector assembly of claim 15, wherein the housing extends along a longitudinal axis of the connector assembly between a first end and a second end, the housing having first and second sides extending between the first and second ends, the crush ribs force the dielectric base in a longitudinal direction along the longitudinal axis toward the first end, the crush ribs force the dielectric base in a lateral direction toward the first side along a lateral axis of the connector assembly that is generally perpendicular to the longitudinal axis.

20. The connector assembly of claim 15, wherein the cavity is oversized relative to the dielectric base to allow the dielectric base to have a limited amount of floating movement within the cavity to align the datum surfaces of the dielectric base with the datum surfaces of the housing.

* * * * *